US008550322B2

(12) United States Patent
Marks

(10) Patent No.: US 8,550,322 B2
(45) Date of Patent: Oct. 8, 2013

(54) SPRING ACTUATED PLIERS STAPLER

(75) Inventor: Joel S. Marks, Sherman Oaks, CA (US)

(73) Assignee: Worktoools, Inc., Chatsworth, CA (US)

( * ) Notice: Subject to any disclaimer, the term of this patent is extended or adjusted under 35 U.S.C. 154(b) by 0 days.

(21) Appl. No.: 13/595,913

(22) Filed: Aug. 27, 2012

(65) Prior Publication Data

US 2012/0318840 A1 Dec. 20, 2012

Related U.S. Application Data

(62) Division of application No. 13/113,594, filed on May 23, 2011, now Pat. No. 8,261,956, which is a division of application No. 12/237,032, filed on Sep. 24, 2008, now Pat. No. 7,950,558.

(60) Provisional application No. 60/985,437, filed on Nov. 5, 2007.

(51) Int. Cl.
*B25C 5/16* (2006.01)

(52) U.S. Cl.
USPC ..... 227/120; 227/132; 227/135

(58) Field of Classification Search
USPC ..... 227/120, 132, 1, 35
See application file for complete search history.

(56) References Cited

U.S. PATENT DOCUMENTS

| | | | |
|---|---|---|---|
| 2,157,987 | A | 5/1939 | Johnson |
| 2,328,839 | A | 9/1943 | Obstfeld |
| 2,340,717 | A | 2/1944 | Vogel |
| 2,358,317 | A | 9/1944 | Crosby |
| 2,433,155 | A | 12/1947 | Peterson |
| 2,574,988 | A | 11/1951 | Vogel |
| 2,580,505 | A | 1/1952 | Balma |
| 2,633,571 | A | 4/1953 | Boroughs |
| 2,755,474 | A | 7/1956 | Spencer |
| 2,801,414 | A | 8/1957 | Mueller |
| 3,103,012 | A | 9/1963 | Kohen |
| 3,368,731 | A | 2/1968 | Lapointe |
| 3,753,524 | A | 8/1973 | Heyward |
| 3,758,016 | A | 9/1973 | Olney et al. |
| 3,834,602 | A | 9/1974 | Obergfell |
| 4,113,164 | A | 9/1978 | Muthenthaller |
| 4,705,202 | A | 11/1987 | Olesen |
| 4,984,729 | A | 1/1991 | Balma |
| 5,335,838 | A | 8/1994 | Harris |
| 5,364,000 | A | 11/1994 | Fealey |

(Continued)

OTHER PUBLICATIONS

PCT International Search Report for PCT/US2008/080753, Dec. 29, 2008, pp. 1-2.

*Primary Examiner* — Brian D Nash
(74) *Attorney, Agent, or Firm* — Paul Y. Feng; The Eclipse Group LLP

(57) ABSTRACT

A spring-energized stapler having a pliers type configuration, wherein papers and like items are fastened at a front end and the stapler is normally gripped and squeezed at a rear end. A compact mechanism and independent handle linkages provide a compact overall shape in a high efficiency action. An upper handle is pivoted at a front, top of a housing with a pressing area spaced at least one half the handle length away from the upper handle pivot. A lower handle includes a multi-segment cam link to a base to provide a minimal gripping distance with a large clamping force at an anvil. A simplified front-loading mechanism provides a compact, low cost assembly. A release latch holder is located behind the striker for a compact front end.

18 Claims, 9 Drawing Sheets

(56) References Cited

U.S. PATENT DOCUMENTS

| | | | | |
|---|---|---|---|---|
| 5,407,118 | A | 4/1995 | Marks | |
| 5,470,009 | A | 11/1995 | Rodak | |
| 5,680,983 | A | 10/1997 | Plyley | |
| 5,704,533 | A | 1/1998 | Chang | |
| D392,858 | S | 3/1998 | Jacquet | |
| D437,755 | S | 2/2001 | Robillard | |
| 6,286,745 | B1 | 9/2001 | Ackeret | |
| 6,918,525 | B2 | 7/2005 | Marks | |
| 7,059,509 | B2 | 6/2006 | Brown | |
| 7,118,019 | B2 * | 10/2006 | Marks | 227/119 |
| 7,124,922 | B2 | 10/2006 | Marks | |
| 7,124,924 | B2 | 10/2006 | Marks | |
| 7,234,621 | B2 | 6/2007 | Marks | |
| 7,252,217 | B1 | 8/2007 | Lin | |
| 7,681,771 | B2 | 3/2010 | Kandasamy | |
| 2002/0108996 | A1 | 8/2002 | Cornett | |
| 2004/0232192 | A1 * | 11/2004 | Marks | 227/120 |
| 2006/0186170 | A1 | 8/2006 | Marks | |
| 2007/0175946 | A1 | 8/2007 | Marks | |
| 2007/0187451 | A1 | 8/2007 | Chang | |
| 2007/0267460 | A1 | 11/2007 | Popowich | |
| 2008/0041912 | A1 | 2/2008 | Marks | |

* cited by examiner 10
30
20
42
40
11
4
4

10
44
30
20
40

330
332
331
10
400
48
122
4A
40
210
120
200
72
75
70
40

43
400
13a
13
48
40, 44
200
46'
13c, 46

15
10
34
30
33

10
57
34
30
33
50
20
40

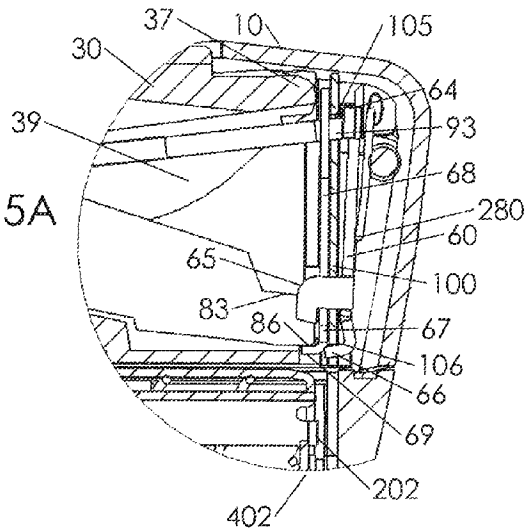
Fig. 15A
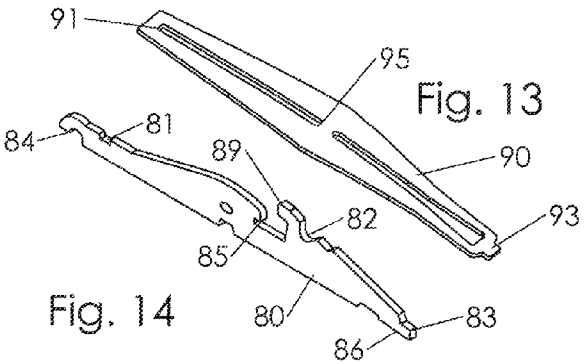
Fig. 13
Fig. 14
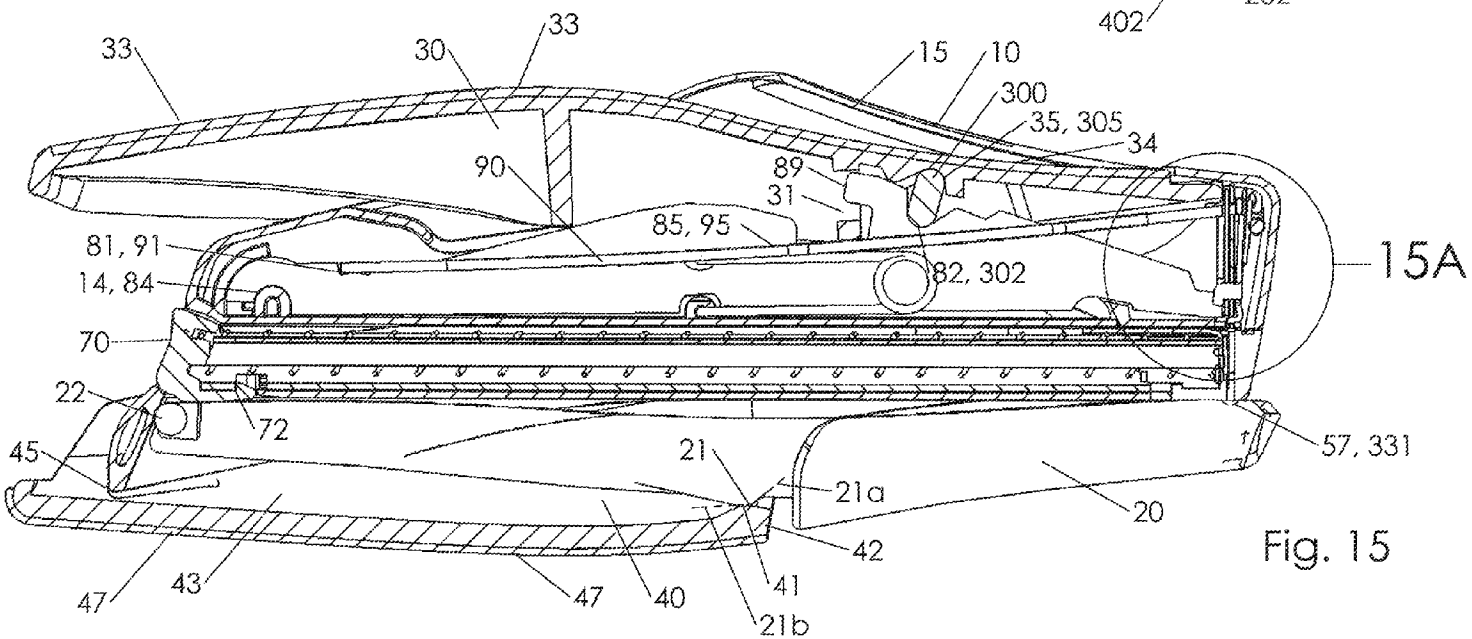
Fig. 15

SPRING ACTUATED PLIERS STAPLER

CROSS-REFERENCE TO RELATED APPLICATIONS

This application is a divisional of application Ser. No. 13/113,594, filed May 23, 2011, now issued as U.S. Pat. No. 8,261,956, which is a divisional of application Ser. No. 12/237,032, filed Sep. 24, 2008, now issued as U.S. Pat. No. 7,950,558, which is a non-provisional application from which priority is based on provisional application No. 60/985,437, filed Nov. 5, 2007, the entire contents of all of which are hereby incorporated by reference.

BACKGROUND OF THE INVENTION

The present invention relates to hand held staplers. More precisely the present invention relates to a pliers type, spring actuated stapler.

Staplers are used generally for fastening sheets of media such as papers together. A staple is forcibly ejected from the device into papers, then legs of the staple are folded behind the papers. There are three common configurations for staplers.

The first configuration is a desktop stapler that rests primarily horizontally on a desk where a handle is pressed downward substantially over where the staple is ejected. The handle and base are both pivotably attached near a rear of the stapler. A secondary mode of operation for a desktop stapler may be squeezing, whereby the stapler is picked up in hand, gripping atop the handle and below the base, and squeezed.

The second configuration of staplers operates by squeezing. Within this category two mode options are common: a vertical stand-up mode, and a non-stand-up mode. Either version is mechanically similar to a desktop type, with the rear pivoting attachment for the handle and base. However, its normal position of use is to be lifted off the desk and squeezed. The stand-up type has a flat front end structure so that the stapler is stable on a desktop with the front pointing down. The second non-stand-up type normally rests on a tabletop on its side. It is also intended to be picked up and squeezed during use.

The third configuration of staplers is a pliers type. A handle is pivotably attached toward a front of the stapler. The handle is squeezed near the rear of the stapler. The handle may be attached along the top or the bottom of the stapler. A hand grips typically around the handle and the body to operate the stapler. A distinct feature of a pliers type stapler is the user's hand is remote from the location of the staple; the hand can thus be spaced away from the work piece. In the typical prior art pliers stapler, the handle is hinged at a position rearward of the front end as defined by the striker location.

SUMMARY OF THE INVENTION

The present invention is directed to a compact, spring actuated pliers stapler including a high efficiency mechanism and low cost construction. The spring actuated mechanism may be a high start type. In a high start spring actuated stapler, the striker has a normal initial rest position above the staple track, moving temporarily to a position in front of the track to drive and eject a staple, then returning to the upper initial rest position. The striker remains stationary as the power spring is deflected and energized. Such an arrangement is particularly suited to a pliers type stapler. In such high start designs, a cage pre-loads the power spring while in a rest position of the mechanism. The cage is also separately pivoted from the handle.

A rotating link connects the handle to the cage, and the cage in turn presses the power spring to deflect the spring and store energy for ejection of a staple. The link provides varying leverage between the handle and the cage whereby an initial upper position of the upper handle includes lower leverage on the power spring, and a lower position of the handle includes higher leverage. The present invention stapler preferably includes separate upper and lower handles independently pivoted to the body at respective upper and lower locations of the body.

The high start mechanism of the present invention preferably includes a latch in front of the striker to hold the striker in its upper rest position as the power spring is energized. The latch normally extends under a lower edge of the striker in the rest position to prevent the striker moving downward. A latch holder selectively retains the latch in its holding position. The latch holder is positioned behind the striker and is triggered by contact with a front tip of the cage as the cage moves downward. An absorber forms a lower limit of motion for the power spring. The absorber preferably includes integrated arms to bias the latch holder toward its rest position to hold the latch.

The present invention in a preferred embodiment includes a cam action between the base and the lower handle to provide an optimum squeezing force at the staple-forming anvil with minimal lower handle travel. This arrangement creates an efficient action along with a compact grip. The present invention may further include a simplified front-loading system that does not require pivoting a handle to expose the staple track for loading. The staple track is substantially fully enclosed from below by a rib of the housing body in the normal track-closed position. A pusher spring is supported on a sheet metal-formed interior bar within the staple track. The bar provides secure guidance to a larger diameter pusher spring than is possible with a conventional rod type guide.

BRIEF DESCRIPTION OF THE DRAWINGS

FIG. 13 is a top perspective view of a power spring.

FIG. 14 is a top perspective view of a cage.

FIG. 15 is a side elevational view of the stapler from FIG. 6, with the stapler depicted in the pressed condition of FIG. 2.

FIG. 15A is a detail view of the stapler front end from FIG. 15, showing a pre-release condition.

DETAILED DESCRIPTION OF THE PREFERRED EMBODIMENTS

A common pliers stapler design includes a lower handle linked to a movable upper element of the stapler body toward a front of the stapler. The lower handle is pivotably linked to a further movable base. This base to handle pivot location is near a rear limit or extent of the paper slot, well rearward of the stapler front end. This pivot is the effective hinge location for driving a staple. In this design, a first, forward-most hinge of a handle may operate to move the base closed, and after the base is at a limit of motion the forward hinge does not operate while a second operative hinge described above provides leverage for moving the striker. In practice, a user may grip the lower handle nearly at this operative hinge. Pressing a lever at its hinge provides minimal leverage or torque on the lever for operation of a mechanism, in this case driving a striker downward.

Figures 1, 2, 3, 4, 4A, 5:
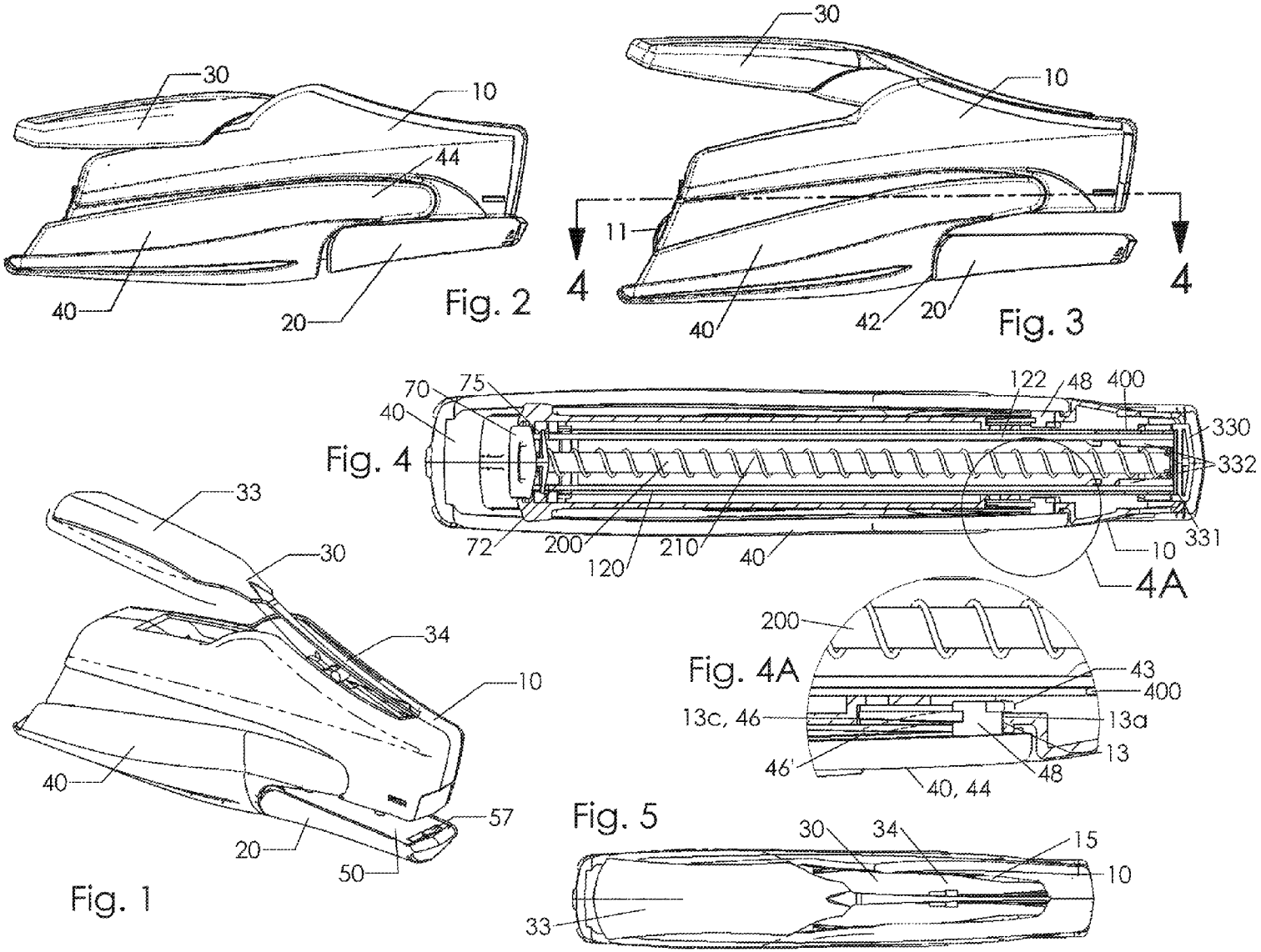
FIG. 1 is an upper front, right side perspective view of a pliers stapler according to one embodiment of the invention.
FIG. 2 is a right side elevational view of the pliers stapler in a pressed condition.
FIG. 3 is the view of FIG. 2, with the stapler in a rest condition.
FIG. 4 is a cross-sectional view of the stapler of FIG. 3 taken along line 4-4 coinciding approximately along a staple chamber location.
FIG. 4A is a detail view of FIG. 4, showing a pivotal attachment location of the lower handle.
FIG. 5 is a top plan view of the pliers stapler of FIG. 1.

The present invention in various preferred embodiments is directed to a spring powered stapler having a pliers type configuration. FIG. 1 shows the compact overall shape of the spring-powered pliers stapler of the present invention. Housing 10, base 20, upper handle 30 and lower handle 40 may be made from molded plastic, die cast metal, formed metal, or combinations thereof.

Figure 6A:
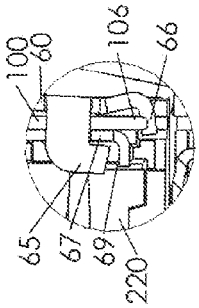
FIG. 6A is a detail view of the front end of the stapler of FIG. 6 showing a rest condition.
Figure 6:
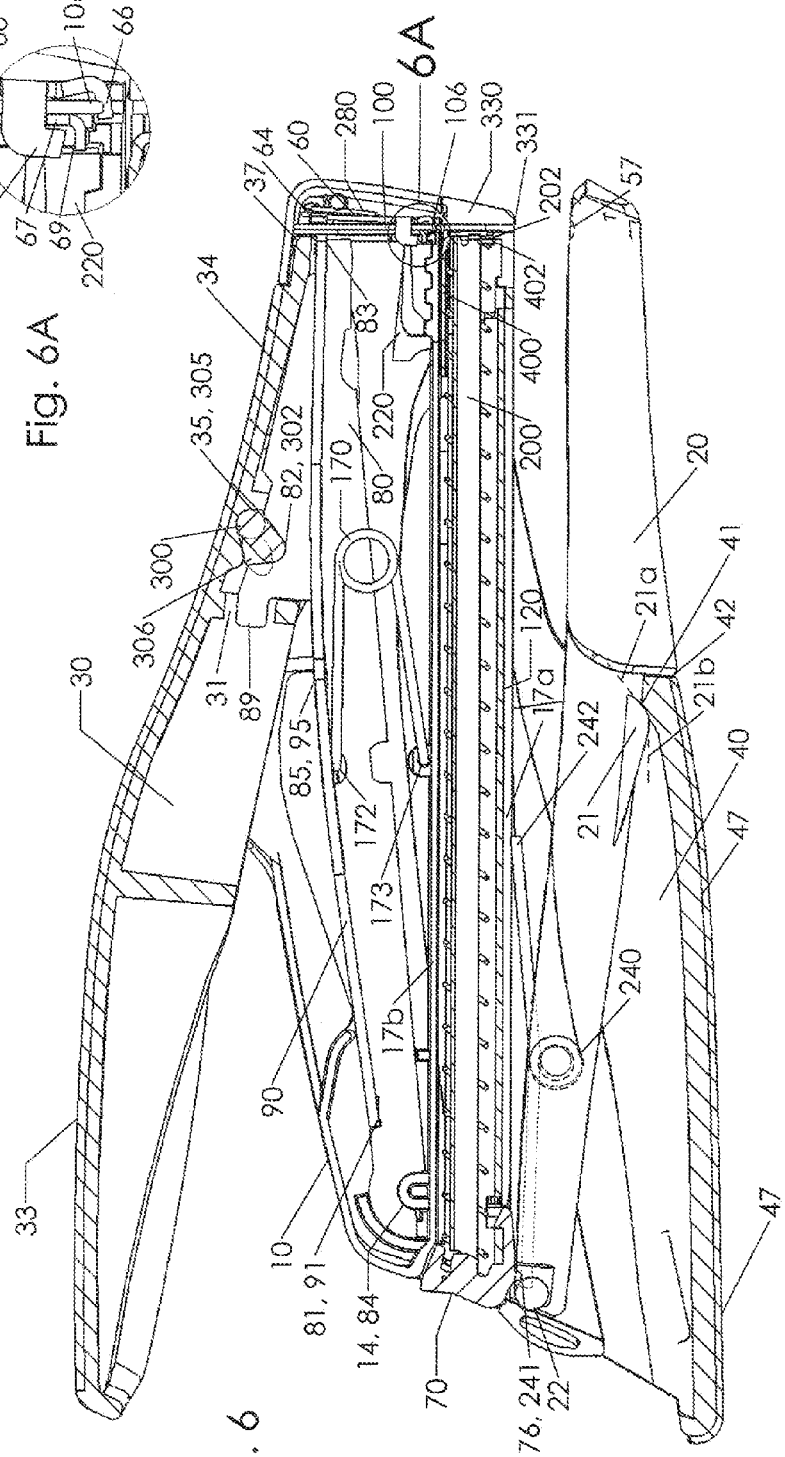
FIG. 6 is the side elevational view of stapler from FIG. 3, with a right housing side removed to expose an interior of the stapler and with some parts shown in cross-section.
Figure 16:
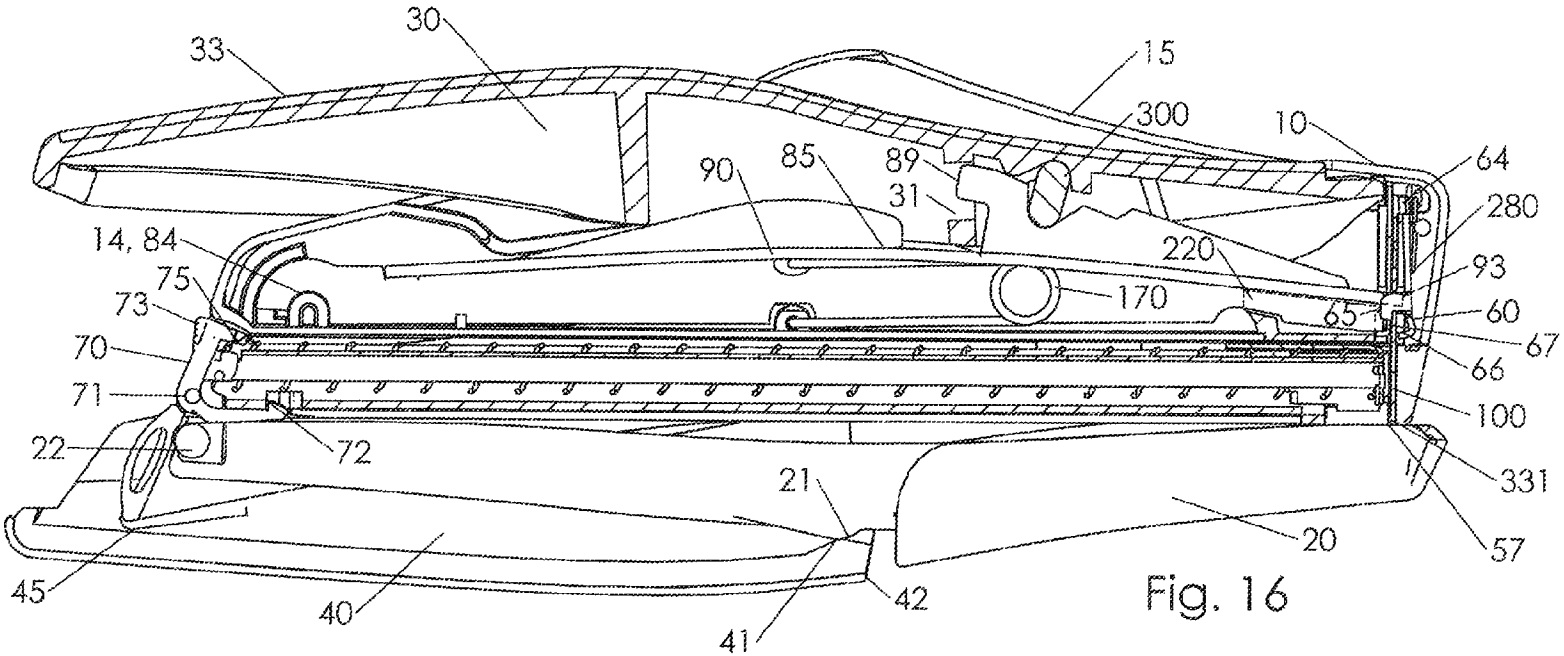
FIG. 16 is a side elevational view of the stapler from FIG. 15, showing a released condition.

As seen in FIG. 6, in operation, upper handle 30 is pressed downward toward housing 10 to energize power spring 90. At a predetermined position of the upper handle, striker 100 is released to eject a staple (not shown) on track 120 (FIG. 16). As a user normally grips around the stapler, lower handle 40 is biased upward toward housing 10. Through a linkage to base 20 (FIGS. 6, 15), anvil 57 of cover plate 50 is urged against staple exit area 331 of nose piece 330 to compress a stack of papers or sheet media (not shown) to be fastened together. Anvil 57 causes staple legs to be formed behind the papers and clinch the paper stack together.

By means of the efficient, compact mechanism described below, the pliers stapler of the present invention has an external dimension in the vertical direction that is also very compact. For example, at a location of striker 100 (FIG. 6), the stapler body includes a vertical height between staple exit area 331 and a top of housing 10 of about 1.1 inch, with a preferred range of between about 0.9 to 1.3 inch inclusive of the end limits and all values therebetween.

One element of the compact design is front portion 34 of upper handle 30 being exposed at a top of housing 10. In this arrangement, upper handle 30 is nested within opening 15 (FIGS. 15 and 24) along the top of housing 10. Accordingly, the stapler at front portion 34 of upper handle 30 may be reduced in height by a thickness of a ceiling of housing 10 as compared to a design where a ceiling was present.

Figure 18:
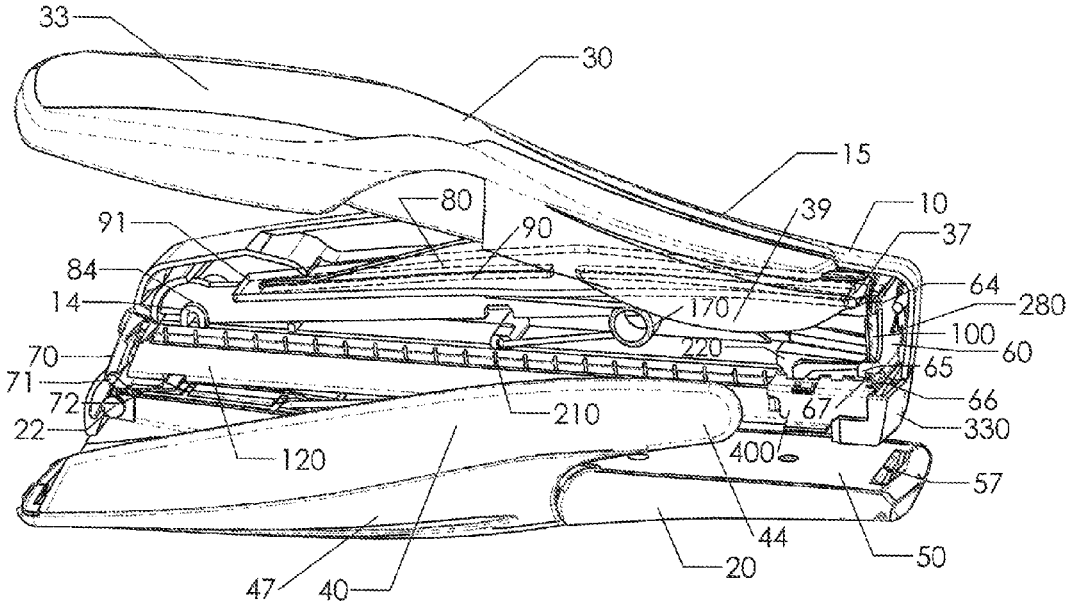
FIG. 18 is a side, front perspective view of the stapler in the condition of FIG. 6.
Figure 24:
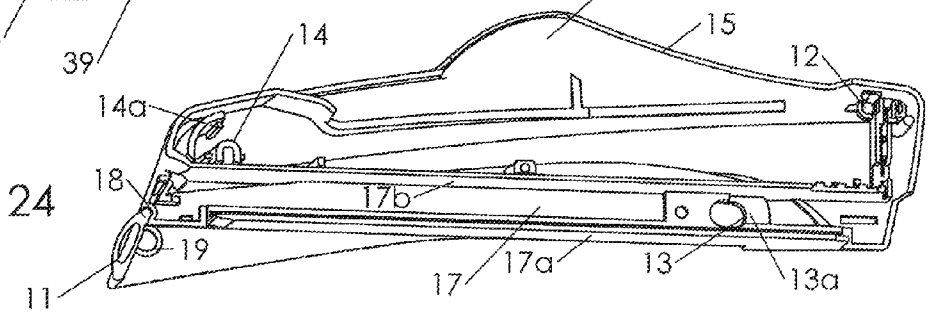
FIG. 24 is a side, lower perspective view of a left housing side.

Another compact design feature of the invention includes ribs 39 of upper handle 30 surrounding sides of power spring 90 (FIGS. 15A, 18, 24). Ribs 39 form a channel in upper handle 30 to provide stiffness to the front portion of upper handle 30, while power spring 90 is nested within a cavity of the handle formed by ribs 39. This reduces the vertical height of the stapler some more. A further compact design feature of the invention is the preferred location for hinge or post 37 of upper handle 30 (FIGS. 6, 18). The hinge 37 is adjacent to striker 100, just rearward of the striker at a front of the stapler. However, upper handle 30 does not extend over striker 100. The upper edge of striker 100 is therefore capped only by a ceiling of housing 10 at the striker location as in FIG. 15A, with no additional height or bulkiness added from the handle material. Therefore, the features described above are among those that allow the pliers stapler of the invention to obtain the preferred compact height of about 1.1 inch at the striker. Such a compact dimension allows the pliers stapler to slip conveniently and unobtrusively into a shirt or vest pocket, briefcase, purse, backpack, etc.

Another feature of the present invention is accommodating a maximum practical handle length yet preserving a compact overall package or size. Accordingly, upper handle 30 and lower handle 40 are independently hinged to housing 10. Upper handle 30 is hinged at handle post 37, fitted to recess or equivalent structure 12 (FIG. 24). Recess 12 is immediately adjacent to a rear of striker 100 at a top of housing 10. Upper handle 30 is normally pressed at pressing area 33 on a rear half of the handle. It is useful to maintain a substantial distance between the handle hinge and the pressing area for improved leverage.

Typical prior art pliers staplers have a gripping portion extending to or very near to an operative lever hinge. In contrast, in a preferred embodiment of the present invention, the normally usable pressing area 33 is distant from hinge 37, preferably spaced from the hinge at least one half the overall handle length. The hinge location is the effective pivot point of the handle for application of leverage to create force on the power spring or striker, as opposed to providing for moving the base. Optionally, the hinge location of upper handle 30 may be in front of striker 100 to provide a greater distance from pressing area 33.

As seen in FIG. 24, the effective hinge 12 for upper handle 30 is positioned above staple chamber 17 as defined at the upper limit by chamber ceiling 17*b* or equivalent structure.

With this arrangement, there need be no portion of upper handle 30 crossing vertically through the stapling device, for example at or vertically across staple chamber 17. Such movement of the handle portions would interfere with other elements of the mechanism requiring additional bulk or clearance to housing 10 or other elements. Hence, this non-crossing design further helps maintain a compact design of the present invention stapler.

Figure 17:
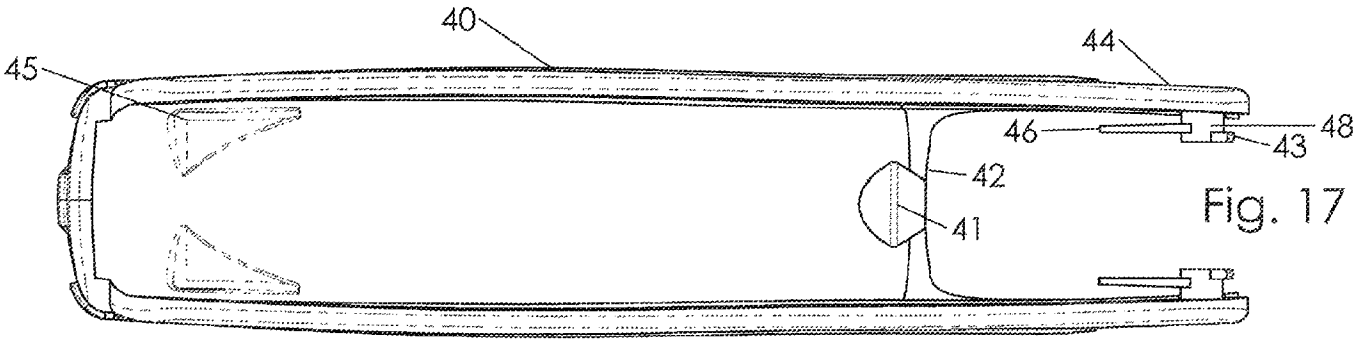
FIG. 17 is a top plan view of a lower handle.
Figure 19:
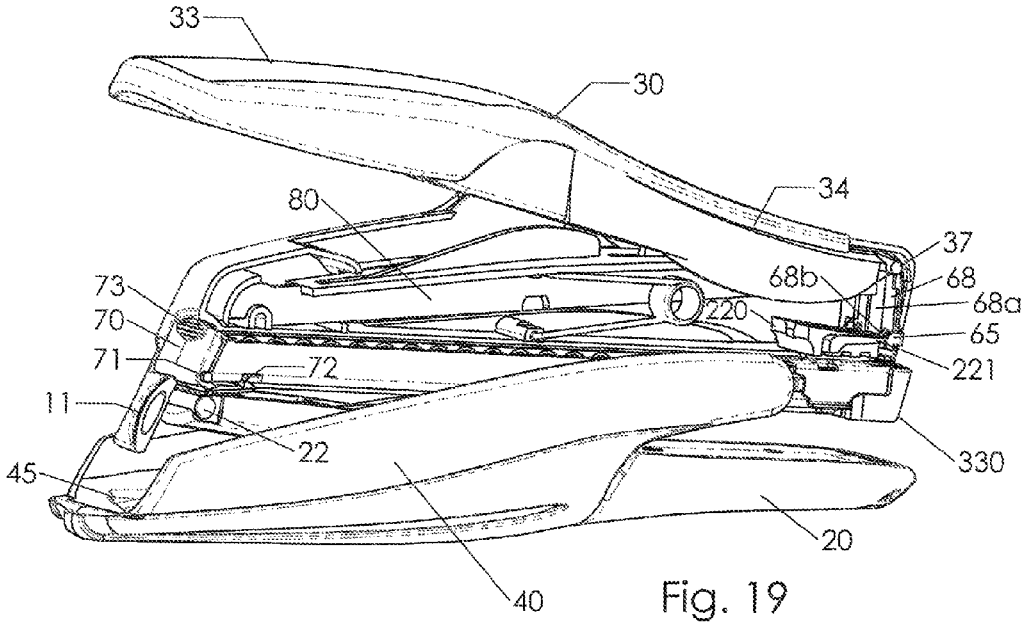
FIG. 19 is a rear perspective view of the stapler of FIG. 18.

In FIGS. 4A, 17, lower handle 40 is hinged to housing 10 at hinge post 48 or equivalent structure within opening 13 of housing 10. In FIGS. 18, 19, lower handle 40 does not cross vertically past staple chamber 17, but rather is preferably hinged near a location of the staple chamber 17 near or below a ceiling 17*b* (FIG. 24).

Base 20 is substantially co-extensive with and generally nests within lower handle 40, being hinged to the housing at pivot 22 of the base 20 in recess 19 of housing 10 (FIG. 24). A sub-assembly of lower handle 40 and base 20 extends under staple chamber 17 and staple track 120 (FIG. 18). The sub-assembly of base 20 and lower handle 40 is linked to the body of the stapler, generally housing 10, independently from upper handle 30. Although both the upper and lower handles are normally operated in tandem, they are preferably linked to operate through a user's hand rather than through a specific component of the stapler.

As discussed above, the placement of a base 20/lower handle 40 sub-assembly substantially below track 120, and upper handle 30 entirely above track 120 results in a dramatically compact pliers stapler, and avoids vertical cross-links between the respective upper and lower handles 30, 40.

Lower handle 40 is preferably linked to base 20 through a cam action. Lower handle 40 includes gripping area 47 that has most of the exposed area along a bottom rear of lower handle 40. In FIG. 6, base 20 includes extra spacing underneath housing 10 at the front to allow a maximum stack of papers, for example 15 to 30 sheets, to be easily inserted into that space below staple exit area 331 with some excess room. To close this excess space after papers are inserted requires only minimal force.

On the other hand, as anvil 57 and staple exit area 331 come in contact and begin to squeeze the paper stack, a higher force is required. For increased leverage, base 20 and lower handle 40 work together. Specifically, rib 41 of lower handle 40 contacts cam surface 21 of base 20. Cam 21 optionally provides varying leverage including at least two distinct segments: steep segment 21*a* and flatter segment 21*b*. In the exemplary embodiment shown in the drawings, these distinct segments are part of a continuous arc. Optionally, they may be straight or nearly straight segments joined by a sharper arcuate portion. For clarity, theoretical tangent construction lines in FIGS. 6 and 15 indicate segments 21*a* and 21*b*. Segment 21*a* forms the base to lower handle 40 contact in the open rest position of FIG. 6. Segment 21*b* forms the contact at or near the closed position of FIG. 15. Base 20 is normally slightly open compared to the fully closed view of FIG. 15, but substantially closed compared to FIG. 6, to allow for the thickness of papers resting on anvil 57. From empirical observations of efficient operation, an angle defined between segments 21*a* and 21*b* (FIG. 6) is at least about 10°, and more preferably ranges from about 25° to 40° inclusive of the outer limits and all values therebetween.

As illustrated with the continuous arc, the angle of contact varies continuously, with an initial range of motion being near segment 21*a*, and a final range of motion being near segment 21*b*. For the initial range of motion, there is low leverage from handle 40 acting on base 20 since the motion of base 20 is enhanced by the relatively steep angle represented by segment 21*a*. In the final range of motion, corresponding to squeezing the paper stack, there is high leverage acting on base 20, which leverage is enhanced as a result of the low angle of segment 21*b*. A benefit of using a varying leverage action for handle 40 acting on base 20 is reduced grip distance. If a single angle or ramp were used, the leverage must be the higher one corresponding to segment 21*b* to enable anvil 57 to clinch staples properly. Then lower handle 40 requires substantially more motion toward housing 10 compared to the multi-segment design of the present invention embodiment. The result is a larger grip distance between upper handle 30 and lower handle 40. Rib 41 also includes a multi-segment or equivalent arcuate profile similar to that of cam 21 as shown to cooperate with cam 21.

In the preferred embodiment, a distance between pressing area 33 of the upper handle and gripping area 47 of lower handle 40, or equivalent upper and lower gripping areas, is preferably a range of about 3 to 3.5 inches inclusive of the outer limits and all values therebetween, and more preferably about 3.2 inches. These compact dimensions are achieved by the above-mentioned features of the present invention. The compact dimensions are beneficial in keeping the overall package small and unobtrusive, and in providing even a small-handed user ergonomic squeezing leverage to operate the pliers stapler.

The rear of the stapler is preferably substantially closed between lower handle 40 and housing 10, as best seen in FIG. 24 where a housing rib including loop 11 extends downward to form a lower rear enclosure for the housing. See also FIG. 19. The right half of housing 10 is not shown in the FIG. 19 drawing to expose the internal components. Lower handle 40 includes optional recesses 45 to allow maximum clearance to housing 10 in the pressed condition of FIG. 15.

Base 20 and lower handle 40 are interlocked near the location of rib 41, as seen in FIGS. 15, 16. Cantilevered arms 44 (FIGS. 17, 18) extending from the front end of lower handle 40 retain base 20 in the upward direction. Rib 41 forms a lower confinement for base 20. Base 20 and lower handle 40 contact at edge 42 of the lower handle in the base-open rest condition of FIG. 6, to form a lower limit of motion for lower handle 40 as the base opens from the pressed condition of FIG. 15. This motion limit defines a maximum paper slot opening above anvil 57.

To achieve a minimal gripping distance, upper handle 30 preferably operates an efficient, energy storage mechanism to eject a staple—namely, power spring 90 and cage 80 are shown in FIGS. 13 and 14, respectively. See also FIG. 6. Power spring 90 is preferably made from spring steel, a highly-elastic metal alloy, or an elastic and tough polymer. Cage 80 is preferably made from non-hardened steel. The spring-cage subassembly is similar to that disclosed in, for example, U.S. Pat. No. 7,404,507 (Marks), and co-pending U.S. application Ser. No. 11/847,132, filed Aug. 29, 2007, titled "High-Start Compact Spring Energized Stapler," both by the same inventor as here, wherein the entire contents of both are incorporated by reference.

In the rest condition of FIG. 6, power spring 90 is confined and pre-loaded (i.e., pre-stressed) by cage 80 when the two are assembled together. Tab 85 of cage 80 presses down on power spring 90 at a central area 95. Rear cage notch 81 supports rear end 91 of power spring 90, while front cage tip 83 supports front spring tip 93. In the pre-release condition of FIGS. 15 and 15A, cage 80 receives link 300 within recess 82; cage 80 is forced down by link 300 which engages upper handle 30 when the upper handle is pressed. Front cage tip 83 moves and becomes spaced below power spring tip 93 as power spring 90 is deflected and energized. Cage 80 rotates about pivot 84 rotating against post 14 of housing 10.

Figure 9:
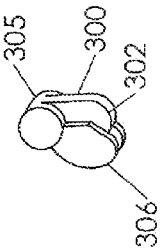
FIG. 9 is a right, front perspective view of a link.

Upper handle 30 is thus indirectly linked to power spring 90 through cage 80. This link preferably undergoes varying leverage too. That is, an initial range of motion of upper handle 30, near the rest condition of FIG. 6, includes lower leverage, faster cage motion; a final range of motion, near the pre-release condition of FIG. 15, includes higher leverage with relatively slower cage motion. Thus, for the varying leverage, link 300 forms a cam type connection between cage 80 and handle 30 (FIGS. 6, 9, and 15).

Link 300 rotatably engages cage 80 at link end 302 in cage recess 82. Recess 82 is preferably located between cage tab 85 and cage tip 83 whereby the cage at recess 82 moves downward faster than the cage at tab 85 and faster than adjacent central area 95 of power spring 90; this results from recess 82 being farther away from post 14 than is tab 85. This faster motion at the handle linking location 82, 300 allows upper handle 30 to have greater leverage on power spring 90 than would result by a direct pressing force acting on power spring central area 95.

Figure 23:
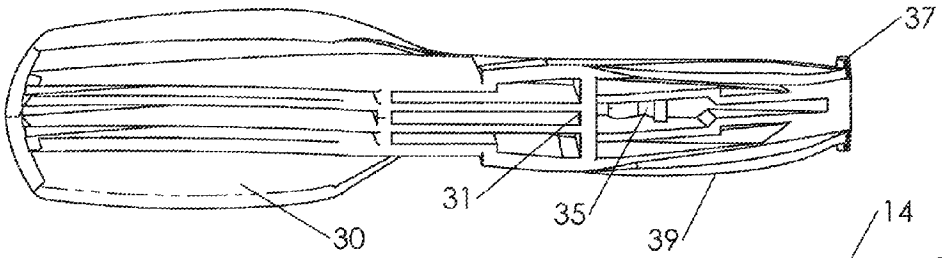
FIG. 23 is a bottom perspective view of an upper handle.

Link 300 is preferably elongated between link lower end 302 and link upper end 305. As seen in FIG. 9, link 300 preferably has an overall T-shape with a rounded barrel upper end 305 and a slab midsection leading to a rounded lower end 302. The slab midsection of link 300 passes between a pair of guide ribs 306. Upper link end 305 rotates within recess 35 of handle 30 (FIG. 23), as guide ribs 306 retain link 300 on the metal, flat shaped cage 90. Upper end 305 and lower end 302 act as cam surfaces.

In the rest condition of FIG. 6, link 300 is steeply angled relative to a length of the cage. In the pressed condition of FIG. 15, link 300 is more vertical within housing 10. As the angle begins to change from what is shown in FIG. 6, cage recess 82 is moved away vertically from handle recess 35. The result is enhanced motion of cage 80 away from handle 30 in this area, or conversely reduced leverage. As link 300 becomes near vertical in the FIG. 15 pressed condition, handle recess 35 moves downward at substantially the same speed as cage recess 82. The relative cage motion decreases and conversely handle leverage increases.

Using varying leverage to energize power spring 90 enables a near constant force acting on handle pressing area 33 while the biasing force from power spring 90 increases through its deflection. Therefore, the handle stroke is used efficiently and may be of minimal pressing distance for a given required energy input to power spring 90.

In summary, both lower handle 40 and upper handle 30 preferably employ varying leverage to allow efficient operation of their respective functions. The gripping distance between the handles 40, 30 is thus minimized. Again, the resulting overall package dimension may thus be kept compact.

Tab 89 of cage 80 extends into slot 31 of handle 30 (FIGS. 6, 15, 15A) to form a tensile link between handle 30 and striker 100 through power spring 90. In an instance that striker 100 resists moving upward from a jam or other malfunction, upper handle 30 may be pulled upward to force striker 100 toward its normal upper position. In the exemplary embodiment, the tensile link to striker 100 is gained via cage 80 and power spring 90.

There are several ways to accelerate the striker into the staple to be ejected. The preferred way is an energy storage means using a spring actuated mechanism known as a "high start" type as discussed earlier, but a "low start" type disclosed in, for example, U.S. Pat. No. 6,918,525 (Marks) or U.S. Pat. No. 7,080,768 (Marks) whose contents are incorporated by reference, may be used too. In the present high start embodiment, striker 100 is normally held in an upper position between the rest condition of FIG. 6 and the pre-release condition of FIGS. 15 and 15A. In FIG. 16 the released condition is shown where striker 100 has ejected a staple from the stapler. Striker 100 has thus moved down to be in front of track 120.

Figure 12:
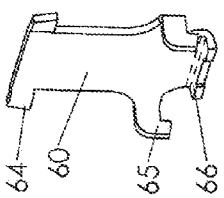
FIG. 12 is a rear, right side perspective view of a latch.
Figure 11:
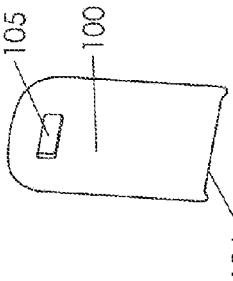
FIG. 11 is a rear, right side perspective view of a striker.
Figure 10:
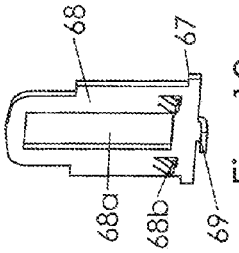
FIG. 10 is a rear, right side perspective view of a latch holder.

A release means normally holds striker 100 in its rest position above staple track 120 as in FIG. 6. Specifically, the release means includes latch 60 (FIG. 12) and latch holder 68 (FIG. 10). Latch 60 is positioned in front of striker 100, pivotably hanging within housing 10 at pivot tabs 64 in housing recess 12 (FIG. 24) or equivalent structure. Latch 60 further includes bottom tab 66 extending rearward under lower edge 106 of striker 100 (FIG. 6A). Bottom tab 66 includes an angled engagement to striker 100 whereby downward pressing from the striker causes a forward pressure or bias on latch 60. The angled engagement can be accomplished by a slight slope to bottom tab 66 as seen in FIG. 12, or by a wedge shape with a slope in the engagement surface. Latch holder 68 selectively retains latch 60 against this forward bias.

Latch holder 68 is positioned behind striker 100. One advantage of this rearward location is that the area of housing 10 in front of striker 100 remains compact since it does not need to accommodate latch holder 68.

According to a preferred embodiment of the invention, latch holder 68 is selectively actuated to release latch 60 by a front end of cage 80. In particular, lower front edge 86 of cage 80 selectively presses tab 69 of latch holder 68 (FIGS. 10, 15A). In an alternative embodiment, latch holder 68 may be actuated through a link to handle 30 (not shown). Such a link may, for example, be a modification of that disclosed in the co-pending Marks application and patent identified above, wherein a front portion of the handle has a rib that presses the latch holder in the downward stroke of the handle thus releasing the latch and striker. In still another alternative embodiment, the front end of the power spring may be used to actuate the latch release mechanism.

Latch holder 68 includes extensions 67 or equivalent structure that normally engage hooked tabs 65 of latch 60 (FIG. 6A). In the pre-release condition of FIG. 15A, cage 80 has moved to a lower most position as upper handle 30 is pressed toward or to a limit near housing 10. In FIG. 15A, cage 80 at lower edge 86 has moved latch holder 68 to translate or slide in a channel or guide of the housing downward, from a latch holder initial position toward a latch holder actuated position, until extensions 67 are beneath and clear of hooked tabs 65. As explained above, bottom tab 66 of latch 60 has an angled engagement to striker 100 whereby the downward pressure from the striker causes a forward pressure on latch 60. Therefore, once extensions 67 are free of hooked tabs 65, lower edge 106 of the striker under downward bias of power spring 90 pushes the bottom of latch 66 forward and away from the path of the striker, thus releasing it to accelerate toward anvil 57 below.

In the pressed condition of FIG. 16, extensions 67 are clear of hooked tabs 65, so latch 60 has rotated or moved about pivot tabs 64 away from striker 100 until latch 60, and specifically its bottom tab 66, is clear of striker 100. The striker 100 is free to move down to eject a staple.

Normally, striker 100 includes a lowest position wherein lower edge 106 is adjacent or closest to anvil 57. Absorber 220 (FIGS. 7, 8) provides a lower limit of motion for power spring 90 (FIG. 16). In the preferred embodiment, latch holder 68 is a flat metal form, extending substantially parallel to striker 100. Latch holder 68 is immediately adjacent to striker 100, sliding near or against the striker as the latch holder is actuated. In the latch holder actuated position, latch 60 moves forward and away from striker 100.

Bottom tab 66 of latch 60 slides lightly along a front face striker 100 as the striker moves downward (FIG. 16) and as the striker returns upward in a reset stroke. Optionally, if spring tip 93 extends far enough through striker opening 105 the spring tip will slidably contact latch 60 in addition to or instead of bottom tab 66 against striker 100. Either sliding engagement holds latch 60 in a position disengaged from striker 100. Latch holder 68 includes slot 68*a* to allow for motion of power spring tip 93.

In FIG. 6, reset spring 170 includes lower pivot mounting leg 173 engaging housing 10 and upper pivot mounting leg 172 engaging cage 80 and/or power spring 90. The mountings preferably include bent leg segments 172, 173 (FIG. 22) to stabilize reset spring 170 in the assembly. In the preferred embodiment, upper leg 172 presses directly on power spring 90; by pressing across a width of the power spring, reset spring 170 is further stabilized along the length of upper leg 172. Alternatively, upper leg 172 or equivalent portion of reset spring 170 may press upward on cage 80 within the corresponding hole of the cage shown in FIG. 6.

Figure 7:
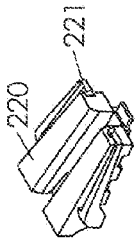
FIG. 7 is an upper front, right side perspective view of an absorber.
Figure 8:
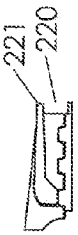
FIG. 8 is a right side elevational view of the absorber of FIG. 7.

In the reset stroke, handle 30 is allowed to rise. Reset spring 170 moves the assembly upward until the striker lower edge 106 moves above bottom tab 66 of latch 60. Latch 60 moves rearward under a light bias from latch spring 280 (FIG. 15A) to re-position bottom tab 66 under striker lower edge 106. A lower edge of hooked tab 65 slides lightly along an upper edge of extension 67 until hooked tab 65 is clear of extension 67. As cage 80 moves toward its upper position, no longer pressing latch holder 68, the latch holder is free to move up to its rest position to restrain latch 60, which moves extensions 67 back into being captured by hooked tabs 65. Specifically, as seen in FIGS. 7, 8, and 19, latch holder 68 is biased upward by bias arms 221 of absorber 220. Bias arms 221 press lightly upward on tabs 68*b* (FIG. 10) of latch holder 68. Absorber 220 is preferably made from a resilient material such as HYTREL® plastic, or like thermoplastic polyester elastomers, or other resilient or rubber-like material. Bias arms 221 are preferably integrated elements molded along with the body of absorber 220. In this manner, latch holder 68 is biased toward its normal rest position without the use of extra components, simplifying assembly and lowering costs.

Track release 70 normally retains staple track 120 under housing 10. It is preferably made from a plastic material, although other materials may be used. In the exemplary embodiment, track release 70 is a single component for a low cost compact assembly. To load staples, track 120 is extended forward to the track-open position shown in FIG. 22. Staples (not shown) are placed on the track behind nose piece 330. As seen in FIG. 16, the track 120 is then pushed rearward to re-engage track release 70. Track release 70 includes catch 72 and pivots 71. Pivot 71 fits into recess or equivalent structure 18 of housing 10 (FIG. 24). Track release 70 further includes pressing area 73 (FIGS. 16, 19) above pivot 71. Track release 70 in this embodiment is substantially exposed at a rear of housing 10 and surrounded by walls of the housing.

Figure 20:
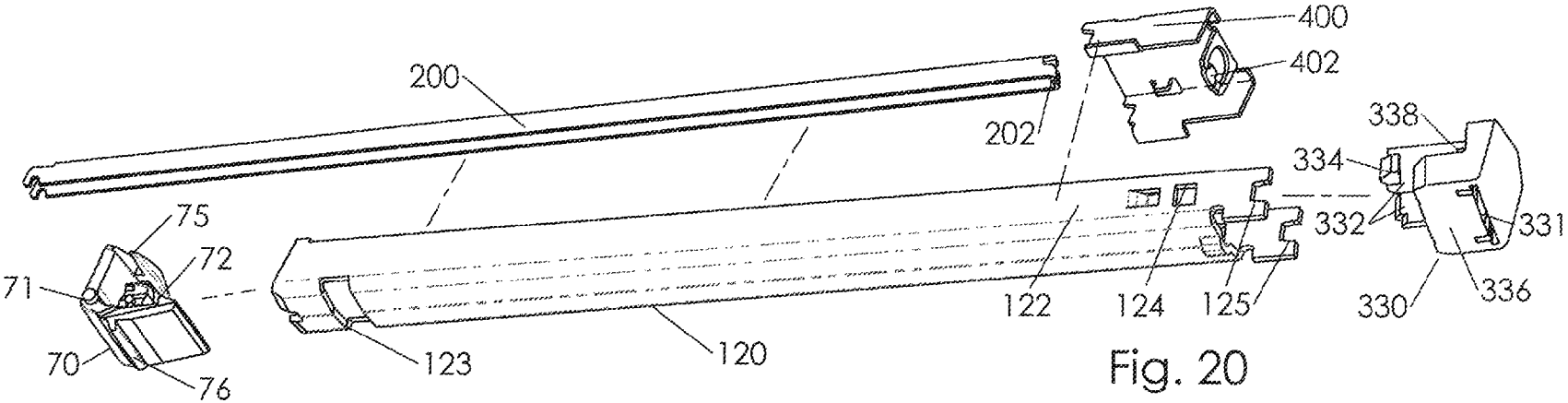
FIG. 20 is an exploded view of an assembly of a track release, track, pusher spring guide, pusher, and nosepiece.

FIG. 20 shows the track assembly in an exploded view. In the normal latched position, catch 72 of track release 70 engages or latches opening 123 of a bottom of staple track 120. Pressing at pressing area 73 causes track release 70 to rotate about pivots 71, and catch 72 moves to disengage the track from housing 10. To assist in initially sliding the track toward the open position of FIG. 22, track release 70 includes optional small bias arms 75. These arms 75 are resilient extensions that provide an initial push to a rear edge of track 120 to cause the track to pop out slightly at nose piece 330. A user may then easily grab the nose piece and fully open the track. Resilient arms 75 also bias track release 70 to rotate it toward its normal engaged position to track 120.

Figure 22:
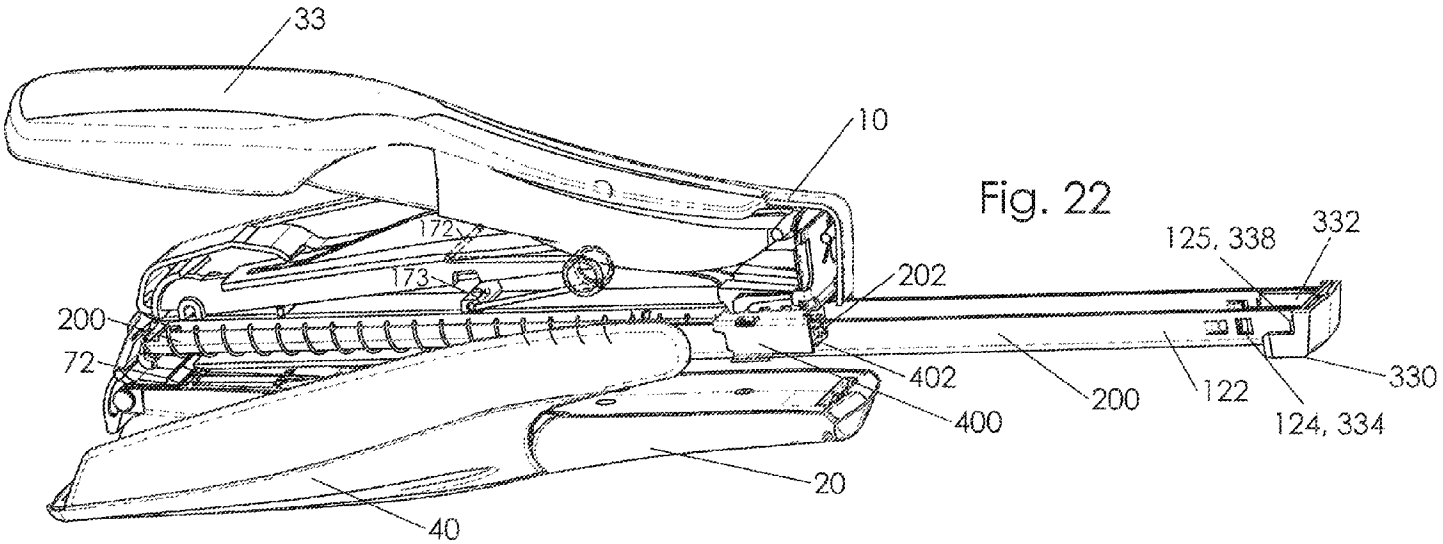
FIG. 22 is a side view of the stapler from FIG. 18 with the track extended forward in a track-open position.

In FIG. 20, nose piece 330 includes rearward extending arms 332 to fit to an interior of side wall 122 of U-shaped track 120, also seen in FIG. 22. Tab or rib 334 engages or mates to opening or edge 124 in side wall 122 of track 120 in FIG. 22 to attach the nose piece 330 within the U-shape of track 120. Tab 338, slightly visible in FIG. 20, and seen in FIG. 22, fits recess 125 of track 120 to further securely support or attach the nose piece at the end of the track. Arms 332 are seen adjacent or contacting the inside of sidewalls 122 in FIG. 4. Floor 336 of the nose piece forms a rear guide of slot 331, as shown in FIG. 20.

Figure 21:
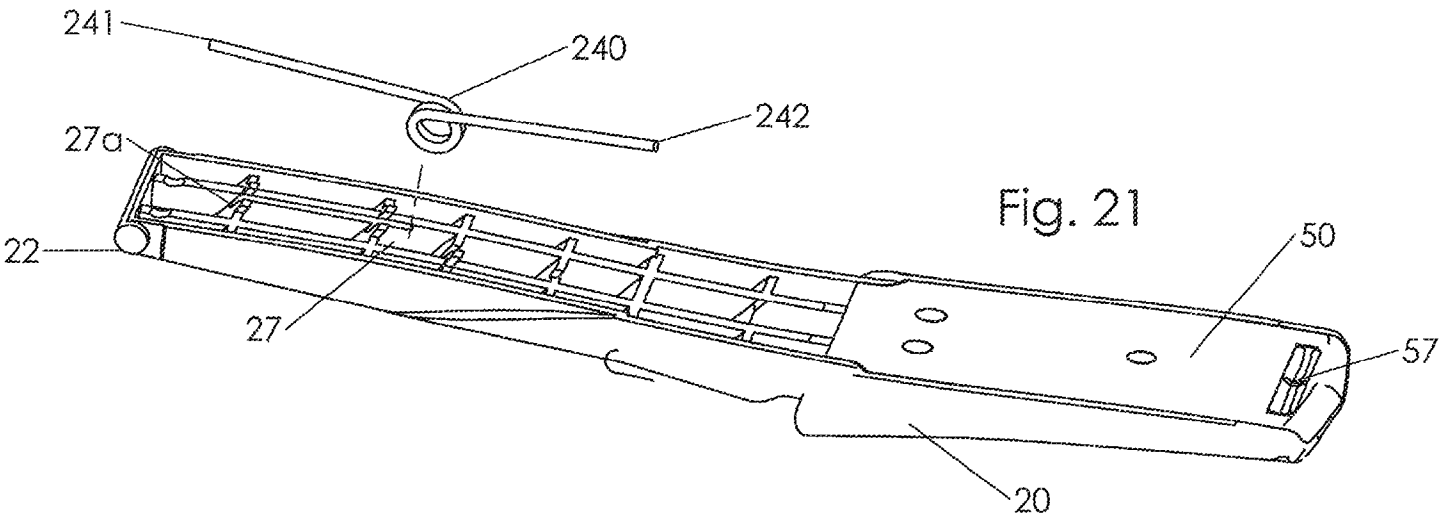
FIG. 21 is an exploded view of an assembly of a base and a base bias spring.

To further assist biasing track release 70 toward its engaged position, base bias spring 240 (FIGS. 6, 21) presses the track release at one end of the spring. Rear spring end 241 presses upward on rib 76 of track release 70. Rib 76 functions as a consistent pressing location for varying angles of the track release. Base bias spring 240 is preferably supported on base 20 in receiving slot 27, with an arm of the spring extending through guide slot 27*a* to hold base bias spring 240 in position. Front end 242 of spring 240 presses upward on housing 10 (FIG. 6); more precisely, spring front end 242 presses on floor 17*a* of staple chamber 17 (FIG. 24). Therefore, in the preferred embodiment, base bias spring 240 achieves two functions: first, to hold base 20 spaced apart from housing 10 to allow a paper stack to be inserted into that space; and second, to bias track release 70 to selectively retain track 120 in its closed operative position.

As shown in the drawings, floor 17*a* substantially, fully encloses staple chamber 17 from below. This helps prevent obstruction of staple track 120 by foreign objects when the track is sliding toward its closed position. Loop 11 at the rear of housing 10 may provide a hanging option. Loop 11 is preferably cast or molded as part of the material of housing 10. Alternatively, it may be a pivotably attached D-ring or like structure. Preferably, the hanging loop is attached below track release 70.

Lower handle 40 includes cantilevered arms 44 at its front to form a forward hinge location upon housing 10 (FIGS. 4A, 17). The cantilever form allows lower handle 40 to bridge the paper insertion area above cover plate 50. It is preferred that the hinge location be secure from being dislodged from housing 10 as the handle is gripped firmly. Otherwise, there may be a tendency for cantilevered arms 44 to splay or spread apart. In the preferred embodiment, an optional snap lock holds the hinge in position. Specifically, hinge post 48 of lower handle 40 pivotably fits opening 13 of housing 10. Forward tab 43 of post 48 extends against interior wall 13*a* of opening 13 (FIG. 24). Post 48 is thereby prevented from pulling out. As lower handle 40 is normally moved, tab 46 rotates about an axis of post 48 adjacent to wall 13*c* of housing 10 (FIGS. 4A, 17). Tab 46 prevents post 48 from moving rearward. This keeps forward tab 43 engaged.

During assembly of lower handle 40 to housing 10, arms 44 are spread apart as posts 48 fit around an exterior of the housing. Lower handle 40 is slid forward until post 48 is near to aligned axially with opening 13. In this position, resilient tab 46 includes the deflected shape at 46' (FIG. 4A) as arms 44 press inward on housing 10. Post 48 is slightly rearward of the position shown in this pre-assembled position. As post 48 moves to the position of FIG. 4A, tab 46 snaps around the corner of wall 13*c* to its normal non-deflected position, and tab 46 is captured in the recess created by wall 13*c* so that post 48 cannot move radially away from a pivot axis defined by opening 13, whereby the lower handle is confined to rotate about the pivot axis. Forward tab 43 secures arms 44 against interior wall 13*a*.

Pusher 400 is best seen in FIGS. 18, 20, and 22. It slides along track 120 to move staples (not shown) on the track toward a front of the track to a position under striker 100. Pusher compression spring 210 (FIGS. 4, 4A) co-extends outside pusher spring bar 200. Pusher spring bar 200 preferably has a large effective diameter, being from one-third (⅓) to one-half (½) an interior width of track 120, as viewed in FIG. 4. With these dimensions, a coil diameter of pusher spring 210 can be maximized while being well supported on the bar. A larger coil diameter allows a maximum practical energy storage by the spring; the effect is a relatively constant force between the most extended condition of the spring as shown in the drawing figures, and a most compressed condition (not shown) as a full rack of staples (not shown) is loaded onto track 120. With a full load of staples, pusher 400 would be in a rear position on track 120, and pusher spring 210 would be compressed. In all cases, pusher spring bar 200 keeps pusher compression spring 210 approximately centered within track 120. In the preferred embodiment, pusher spring bar 200 is made from formed sheet metal worked into an inverted U-shape. This is a sturdy, low cost design for an enlarged spring support structure.

In the track open position of FIG. 22, pusher 400 is preferably retained from extending past striker 100, giving room for staple loading on pusher spring bar 200. In the preferred embodiment, pusher spring bar 200 includes a folded end 202 (FIGS. 15A, 20). Pusher 400 includes a folded front portion with tab 402. Tab 402 forms a front limit of motion for the pusher along bar 200. At the front limit, tab 402 contacts folded end 202 to prevent further motion forward. This arrangement prevents pusher 400 from moving below striker 100 as the last staple in the staple rack (not shown) on track 120 is used. Also, the pusher limit tab 402 holds pusher 400 in position behind striker 100 as track 120 is moved outward in FIG. 22 so that there is room on the extended track for a fresh rack of staples. Pusher 400 may normally be assembled to bar 200 from the rear end of the bar.

Figure 28:
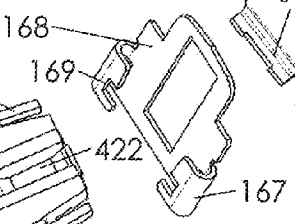
FIG. 28 is a top, rear perspective view of a latch holder according to an alternative embodiment of the invention.

FIGS. 25 to 32 show an alternative embodiment absorber and release design. In the drawings, some components are removed for clarity, including power spring 90. According to this embodiment, absorber 420 (FIG. 27) provides a link between cage 80 and latch holder 168 (FIG. 28). Cage 80 normally presses latch holder 168 in a release action as discussed with respect to latch holder 68 above, and in detail for the present embodiment below.

Absorber 420 provides a lower limit of motion for a power spring such as power spring 90 of FIG. 13. Absorber 220 or 420 may be a resilient and/or elastomeric material to reduce shock transmission on housing 10 of the stapler. This may occur, for example, when the stapler is fired empty; the major portion of energy stored in the power spring is absorbed as the spring suddenly stops at its lowest position as in FIG. 16.

It may be desirable to partially isolate latch holder 168 from cage 80 in the event that the shock from the end-of-stroke condition is transmitted to the latch holder. It is possible that cage 80, while in a lower position, is impacted by the power spring if, for example, an early release occurs. Cage 80 may be located slightly above its lowest position of FIG. 31, and the power spring may then impact cage tip 83. Cage 80 then moves abruptly downward. To prevent damage to latch holder 168, the resilient material of absorber 420 isolates the latch holder from any impact as discussed next.

Figure 25:
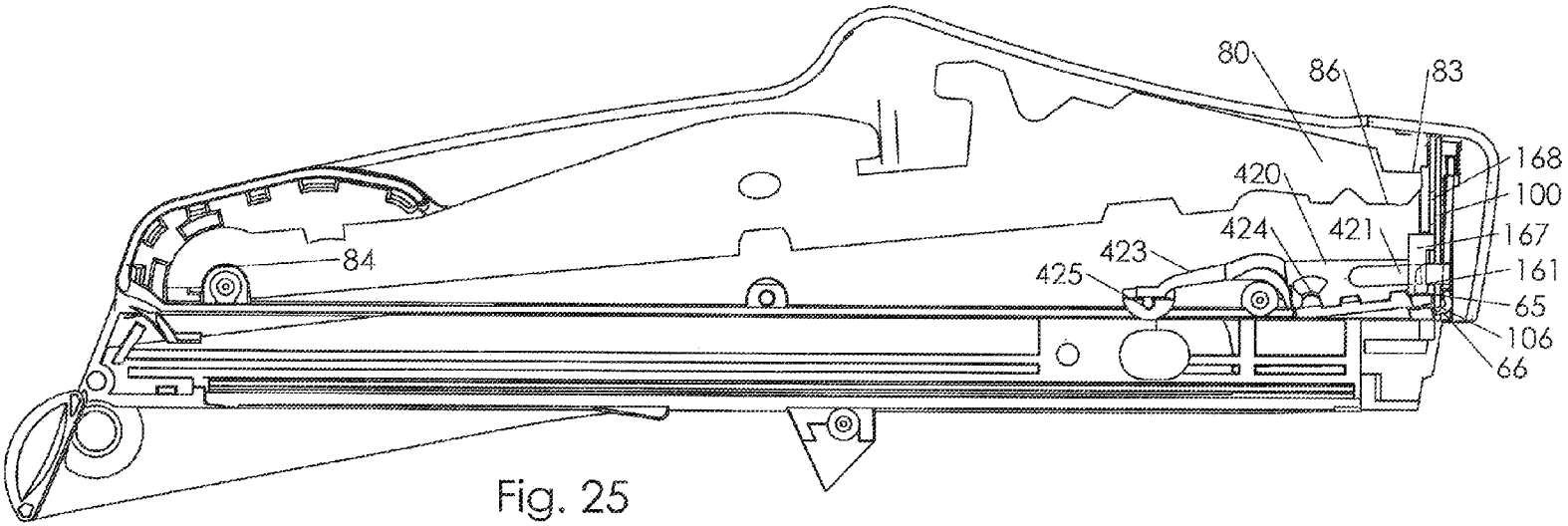
FIG. 25 is side elevation view of a simplified assembly of a pliers stapler according to an alternative embodiment release mechanism.
Figure 26:
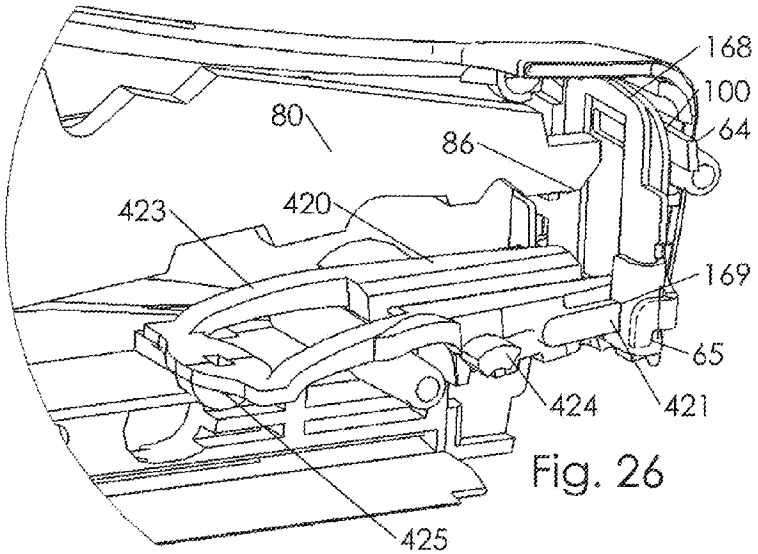
FIG. 26 is perspective detail view of a front portion of the stapler of FIG. 25.
Figure 29:
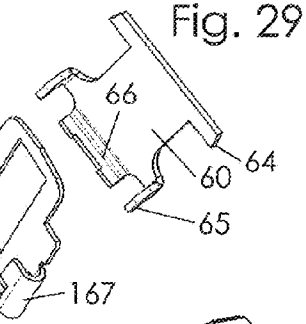
FIG. 29 is a top, rear perspective view of the latch of FIG. 12.
Figure 30:
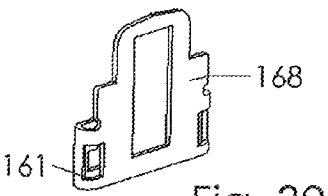
FIG. 30 is a front, right perspective view of the latch holder of FIG. 28.

In the rest condition, cage 80 and latch holder 168 are in respective upper positions shown in FIGS. 25 and 26. Latch 60 includes bottom tab 66 under striker lower edge 106. Striker 100 is thereby held in its upper rest position. The relative positions of latch holder 168 is readily seen by comparing the top edge of the latch holder between FIGS. 26 and 32 with respect to a top edge of striker 100, which is not moved. In the rest condition, hooked tab 65 of latch 60 is engaged (hidden view in FIG. 26) and extends forward past edge 161 (FIG. 30). See also hooked tabs 65 in FIG. 6A embodiment. Latch holder 168 is raised in the upper position so hooked tab 65 is captured by edge 161. Preferably there are at least two hooked tabs 65 as shown.

Openings 169 face rearward from latch holder 168. Arms 421 of absorber 420 engage the openings (FIG. 26). Absorber 420 is pivotably or movably mounted to housing 10. In the illustrated embodiment, absorber 420 pivots, hinges, and/or flexes about pivot 424. Spring arms 423 extend to rear housing attachment 425. Spring arms 423 include a light pre-load to bias the front of absorber 420, including arms 421, upward. Pressing the front end of absorber 420 downward causes spring arms 421 to press at openings 169, and latch holder 168 moves downward to the position of FIGS. 31, 32. Edge 161 is entirely below tab 65 of the latch, so latch 60 is now free to rotate forward to release striker 100 from latch bottom tab 66. See also discussion regarding FIGS. 6A and 15A above for the operation of latch 60.

Figure 27:
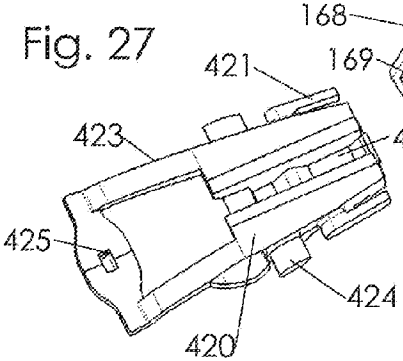
FIG. 27 is a top, rear perspective view of an absorber according to an alternative embodiment of the invention.
Figure 31:
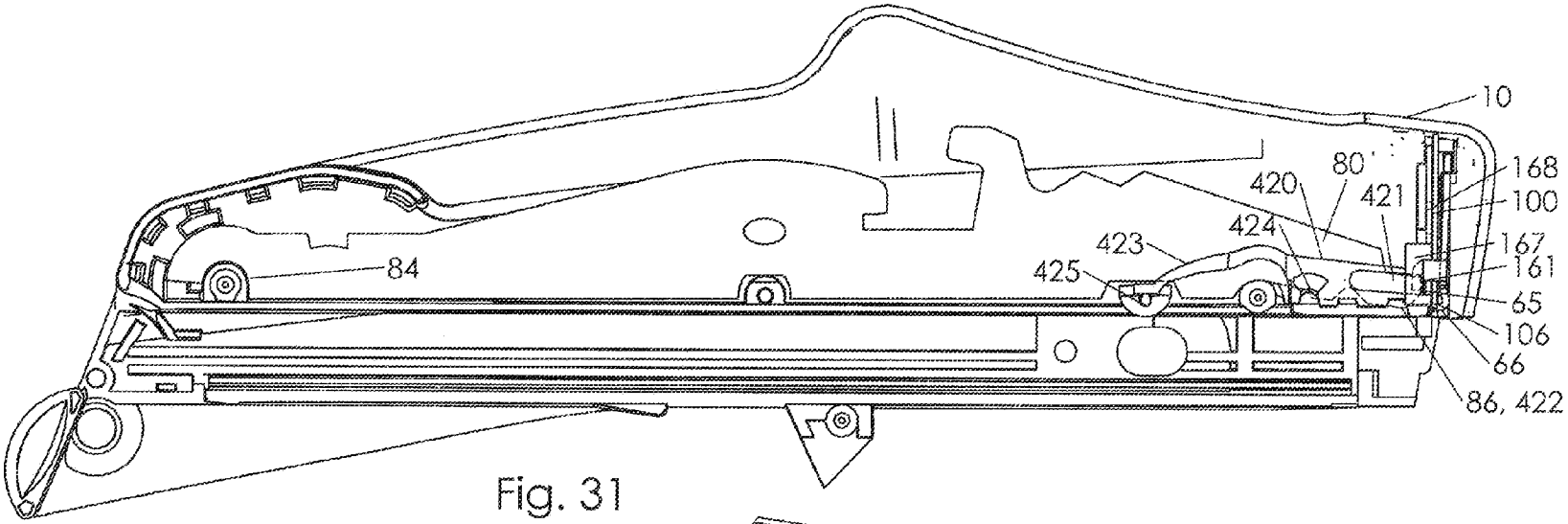
FIG. 31 is the stapler of FIG. 25 in a pressed condition.
Figure 32:
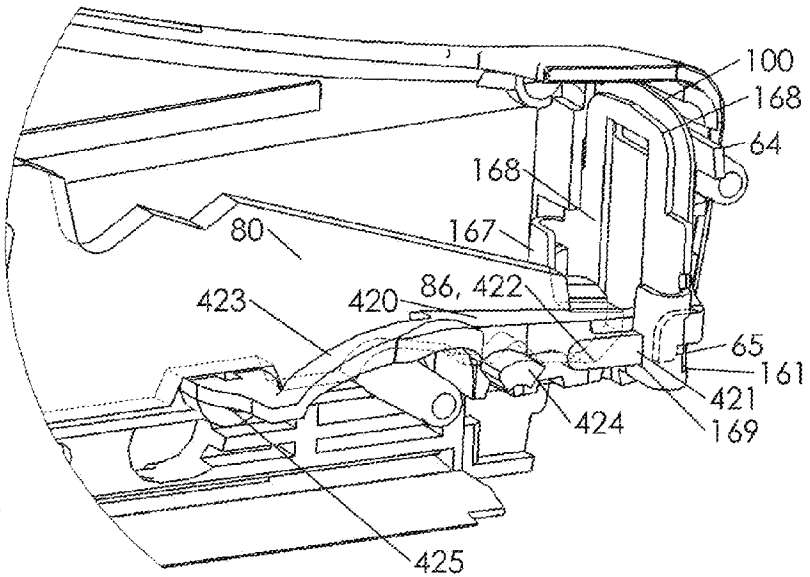
FIG. 32 is a partial perspective view of FIG. 26 in a pressed condition.

In the release action, cage 80 moves to its lowest position to press absorber 420 at lower front edge 86 on floor 422 of the absorber (FIG. 27). According to the present embodiment, absorber 420 is a compliant linkage between cage 80 and latch holder 168. Other indirect or direct linkages may be used. For example, an element fixed to or positioned on either the cage or latch holder may link them respectively.

From the foregoing detailed description, it should be evident that there are a number of changes, adaptations and modifications of the present invention that come within the province of those skilled in the art. However, it is intended that all such variations not departing from the spirit of the invention be considered as within the scope thereof except as limited solely by the following claims.

What is claimed is:

1. A stapler device, comprising:

a housing body including a track chamber along a bottom thereof;

a handle pivotably attached to the housing body;

a striker movable vertically in the housing body between a normal initial upper position above a staple track and a lower position in front of the staple track;

the staple track co-extensive with the track chamber, the staple track including a closed operative position under the housing body, and a track-open position extending forward from the housing body;

a track release pivotably attached at a rear of the housing body including a normal engaged position retaining the staple track in the closed operative position and a released position wherein the staple track is free to slide forward in the housing toward the track-open position, the track release including a pressing area exposed at a rear of the housing body, and a catch of the track release below the staple track, the track release including a single plastic molded element including the pressing area and the catch;

the track release pivots upon the housing from the engaged position toward the released position when the pressing area is pressed; and a resilient arm of the track release moves to press on the staple track when the track release pivots, the arm being a resilient link between the track release and the staple track which biases the staple track to move forward.

2. The stapling device of claim 1, wherein a base is pivotably attached to the housing body, the base including an anvil located below the striker, and wherein a base bias spring is fitted to the base including a rearward extending spring arm pressing the track release toward the normal engaged position.

3. The stapling device of claim 2, wherein a rib of the track release extends from the track release, and the rearward-extending arm of the spring presses the rib.

4. The stapling device of claim 2, wherein a forward extending arm of the spring presses an underside of the housing body, wherein the base is biased to move away from the housing body.

5. The stapling device of claim 1, wherein the resilient arm is of the plastic molded element, and the resilient arm normally biases the track toward the track open position.

6. A stapler device, comprising:

a housing body including a track chamber along a bottom thereof;

a handle pivotably attached to the housing body;

a staple track extending within the track chamber, the staple track including a closed operative position under the housing body, and a track-open position extending forward from the housing body;

a striker movable vertically in the housing body between a normal initial upper position above the staple track and a lower position in front of the staple track;

a track release pivotably attached at a pivot location of the housing body including a normal engaged position retaining the staple track in the closed operative position and a released position wherein the staple track is free to slide forward in the housing toward the track-open position;

the track release including a substantially vertical portion at least partially exposed at a rear of the housing, an arm of the track release above the pivot location resiliently movable in relation to the vertical portion to selectively press forward upon the staple track, and a forward extending portion of the track release with a latch toward an end of the forward extending portion; and the track release pivots upon the housing from the engaged position toward the released position when a pressing area is pressed, and when the track release pivots to a predetermined position the resilient arm links the track release to a rear of the staple track to cause the staple track to move forward.

7. The stapling device of claim 6, wherein the forward extending portion includes a latching edge to selectively engage the track, and at the predetermined position of the track release the latching edge disengages from the track.

8. The stapling device of claim 6, wherein the resilient arm provides an initial push for the forward motion of the track, and after the initial push the track is moved further by a user pulling directly upon the track.

9. The stapling device of claim 6, wherein the resilient arm presses the track to bias the track release to move toward the engaged position.

10. The stapling device of claim 6, wherein the resilient arm provides an initial push for the forward motion of the track, and the resilient arm further presses the track to bias the track release to rotate toward the engaged position.

11. The stapling device of claim 6, wherein the track release is a single molded component, and the resilient arm is of the single molded component.

12. The stapling device of claim 11, wherein the track release includes a forward extending portion, the forward extending portion includes a latching edge to selectively engage the track, and at a predetermined position of the track release the latching edge disengages from the track.

13. The stapling device of claim 12, wherein the resilient arm causes the track to move forward at the predetermined position.

14. The stapling device of claim 11, wherein the track release includes a substantially vertical portion at least partially exposed at a rear of the housing.

15. The stapling device of claim 11, wherein the resilient arm presses forward upon a rear end of the track from above the pivot location.

16. The stapling device of claim 11, wherein a further spring of the stapler biases the track release toward the engaged position.

17. The stapling device of claim 6, wherein a further spring of the stapler biases the track release toward the engaged position.

18. A stapler device, comprising:

a housing body including a track chamber along a bottom thereof;

a handle pivotably attached to the housing body;

a staple track within the track chamber, the staple track including a closed operative position under the housing body, and a track-open position extending forward from the housing body;

a striker movable vertically in the housing body between a normal initial upper position above the staple track and a lower position in front of the staple track;

a track release pivotably attached at a pivot location toward a rear of the housing body including a normal engaged position retaining the staple track in the closed operative position and a released position wherein the staple track is free to slide forward in the housing toward the track-open position;

the track release including a resilient arm that is resiliently movable in relation to the track release; and the resilient arm presses forward upon the staple track to cause the staple track to be biased forward, and a corresponding force from the resilient arm causes the track release to be biased to pivot toward the engaged position.

* * * * *